US005267001A

United States Patent [19]

Kanai et al.

[11] Patent Number: 5,267,001

[45] Date of Patent: Nov. 30, 1993

[54] IMAGE FORMING CARTRIDGE

[75] Inventors: Makoto Kanai; Hiromitsu Koizumi, both of Saitama, Japan

[73] Assignee: Fuji Xerox Co., Ltd., Tokyo, Japan

[21] Appl. No.: 884,026

[22] Filed: May 18, 1992

[30] Foreign Application Priority Data

Feb. 1, 1991 [JP] Japan ..... 3-54190

[51] Int. Cl.[5] ..... G03G 15/02; G03G 21/00

[52] U.S. Cl. ..... 355/219; 355/200

[58] Field of Search ..... 355/200, 210, 260, 219

[56] References Cited

U.S. PATENT DOCUMENTS

| | | | |
|---|---|---|---|
| 4,375,328 | 3/1983 | Tsuchiya et al. | 355/210 |
| 4,607,941 | 8/1986 | Honda | 355/210 |
| 4,708,455 | 11/1987 | Kubota et al. | 355/211 |
| 4,873,548 | 10/1989 | Kobayashi et al. | 355/200 |
| 4,920,379 | 4/1990 | Nakanishi et al. | 355/210 |
| 5,047,803 | 9/1991 | Kanoto | 355/211 |
| 5,089,850 | 2/1992 | Ogura et al. | 355/219 X |

FOREIGN PATENT DOCUMENTS 60-63549 4/1985 Japan .

*Primary Examiner*—Fred L. Braun

*Attorney, Agent, or Firm*—Finnegan, Henderson, Farabow, Garrett & Dunner

[57] ABSTRACT

An image forming cartridge which is arranged to be removably attached to a body of an image forming apparatus. The image forming apparatus includes a latent image forming unit for forming an electrostatic latent image corresponding to image information onto a photoreceptor, a developing unit for developing the latent image formed by the latent image forming unit, a transfer unit for transferring the image developed by the developing unit onto a transfer material, a discharging unit for radiating discharge light onto the photoreceptor to thereby discharge the photoreceptor after transfer operation by the transfer unit, and a feed unit for feeding the transfer material to the transfer unit and for discharging the transfer material after transfer operation by the transfer unit. The image forming cartridge includes at least the photoreceptor, the developing unit, and a discharge light path for leading the discharge light to the photoreceptor as one body, and the discharge light path is bent so as to bend a light axis of the discharge light.

5 Claims, 3 Drawing Sheets

IMAGE FORMING CARTRIDGE

BACKGROUND OF THE INVENTION

The present invention relates to an image forming apparatus for forming an image onto a transfer material, and particularly relates to an image forming cartridge for use in an image forming apparatus of the electrophotographic type such as a copying machine, a laser beam printer, or the like.

A copying machine and a laser beam printer are conventionally known types of electrophotographic image forming apparatus. Here, the laser beam printer will be described.

FIG. 3 is a diagram for schematically explaining the configuration of a laser beam printer. A laser beam printer 11 has a laser scanner 12. The laser scanner 12 is provided with a semiconductor laser 13 for outputting a laser beam modulated on the basis of an image signal. The laser beam emitted from the semiconductor laser 13 is incident into a polygon mirror 14 and deflected in accordance with the rotation of the polygon mirror 14. After passing through an $f\theta$ lens 15, the deflected laser beam is changed in its traveling direction through mirrors 16 and 17 and outputted from the laser scanner 12.

A photoreceptor drum 19 is disposed below the laser scanner 12 so as to rotate at a fixed speed. The laser beam outputted from the laser scanner 12 repeatedly scans a predetermined exposure position 21 of the photoreceptor drum 19 in its axial direction, that is, in the main scanning direction. A charge corotron 22 is provided in a position opposing the photoreceptor drum 19 slightly circumferentially spaced from the exposure position 21 so that a given point on the surface of the photoreceptor drum 19 is uniformly charged before it reaches the exposure position 21. The charged photoreceptor drum 19 is irradiated with the laser beam so that an electrostatic latent image corresponding to image information is formed on the drum surface. The electrostatic latent image is developed by a developing device 24 at a portion of the drum surface downstream along the path of rotation of the drum 19 from the exposure position 21. Members such as a developing roll 25 for developing an electrostatic latent image by means of magnetically spiked toner, a toner supply mechanism 26 for supplying the developing roll 25 with toner out of a cartridge, and the like, are provided in the developing device 24. A predetermined development bias voltage is applied to the developing roll 25.

The toner image formed on the photoreceptor drum 19 by the developing device 24 is moved to a position opposite to a transfer corotron 28 as the photoreceptor drum 19 rotates, and is electrostatically transferred onto recording paper (ordinary paper). Each of the charge and transfer corotrons 22 and 28 used in this example has such a configuration that a single corotron wire is stretched in an air space covered with a shielding member and a voltage application terminal is provided at one end of the wire.

Next, a recording paper feeding path will be briefly described. Sheets of recording paper (not shown) are stacked in a cassette tray 31 removably disposed in a lower portion of the laser beam printer 11. The uppermost sheet of recording paper in the cassette tray 31 is fed out of the tray 31 by means of a semicircular roll 32. In place of the semicircular roll 32, sometimes, another means such as a retard roll or the like may be used.

The fed out recording paper is advanced by feeding rolls 33 along a path shown by a broken line and stopped from advancing once when the paper has reached front ends of resist rolls 34. Thereafter, an electromagnetic clutch (not shown) makes the resist rolls 34 start to rotate in synchronism with the rotational position of the photoreceptor drum 19 so that the stable feeding of the recording paper at a fixed speed is started. Thus, the recording paper passes in a timed manner between the photoreceptor drum 19 and the transfer corotron 28. The transfer corotron 28 performs discharging only at the time of this passage of the recording paper so that the toner image on the photoreceptor drum 19 is electrostatically attracted toward the transfer corotron 28 and transferred onto the recording paper. The back surface of the recording paper, after toner image transfer, is erased or discharged by means of erasure needles (not shown) arranged downstream from the transfer corotron 28 so that the recording paper is separated from the drum surface during erasive. After being fed along a feeding path of a predetermined length so as to release its tension, the recording paper, now separated from the drum surface, is sent to a fusing device made of a pair of rolls, that is, a heat roll 6 and a pressure roll 8. In the fusing device, the recording paper passes between the heat and pressure rolls 6 and 8 which are nip rolls separated by a predetermined width. At this time, the recording paper surface carrying the toner image transferred thereto faces the heat roll 6 while the recording paper is pressed by the pressure roll 8 against the heat roll 6 allowing for efficient heat conduction. The heat roll 6 is controlled to be at a fixed high temperature. In this state, the toner image on the recording paper is thermally fixed on the paper surface.

A selector valve 38 is provided in the outlet of the fusing device so as to switch the path for feeding the recording paper after fusing. By the switching operation of the selector valve 38, the recording paper after fusing travels straight so as to be discharged in the first discharge direction 39, or the paper after fusing is turned rightward (as shown in FIG. 3) so as to be discharged from an upper portion of the laser beam printer 11 in the second discharge direction 41 substantially opposite to the first discharge direction 39. The reason for the two discharge directions as described above is to make it possible to select whether the recording paper is to be discharged with its recording surface turned upward or downward. If recording paper is discharged with its recording surface turned downward by selecting the second discharge direction 41, sheets of recording paper successively printed page by page can be bound by a stapler as they are in proper numerical order.

The toner image which has not been transferred onto the recording paper is removed from the drum surface by a cleaning device 43 arranged downstream along the direction of rotation of the drum 19 from of the transfer corotron 28. The cleaning device 43 is provided with a blade 44 for scraping toner from the drum surface and a rotary body 45 for displacing toner particles accumulated under the blade 44 to a storing position in the rear side of the cleaning device 43.

Then, the photoreceptor drum 19 cleaned by the o cleaning device 43 is discharged by means of a discharge device 62. Generally, an erasure lamp is used as the discharge device 62, and an LED is used as the lamp. Further, the discharge operation is sometimes performed before cleaning depending on the kind of the apparatus. Then, the photoreceptor drum 19 discharged by the discharge device 62 is charged again by the charge corotron 22, and the operation is shifted to the next cycle.

Recently, miniaturization of image forming apparatuses such as laser beam printers or the like has been progressed. Miniaturization of photoreceptor drums has been also progressed with the miniaturization of the image forming apparatus. At present, photoreceptor drums have been miniaturized to the diameter of about 30 mm from about 80 mm several years before.

The miniaturization of a photoreceptor drum causes a problem concerning space available for constituent parts required to be arranged around the photoreceptor drum. As seen in the above explanation about the outline of the laser beam printer, it is necessary to provide a charger, an exposure device, a developing device, a transfer device, a separation device, a cleaning device, and a discharge device around the photoreceptor drum. Of those constituent parts, the parts other than the exposure device require a relatively large space, while only the exposure device occupies a very small space if a laser scanner is used. Particularly, it is necessary to prepare a considerably large space for the transfer and separation devices because it is necessary to secure a space for making a transfer material (recording paper) pass between the photoreceptor drum and each of the transfer and separation devices.

It is therefore very difficult to design the remaining parts, that is, the charger, the developing device, the cleaning device, and the discharge device. The discharge device, which has a tendency to be considered lower in importance than the charger, the developing device, and the cleaning device, is sometimes displaced to a position immediately after the separation device and before the cleaning device. If the discharge device is arranged in such a position, however, discharge operation is performed over non-transferred toner on the photoreceptor drum, so that the printing quality is deteriorated because the surface of the photoreceptor drum on which toner remains cannot be sufficiently discharged. It is therefore desirable to perform discharge operation immediately after cleaning.

An image forming cartridge called an EP (electronic printing) cartridge, in which a photoreceptor drum is integrally provided with a charger, a developing device, and a cleaning device, and which is removably attached to the body of an image forming apparatus, has become popular because of its superiority in maintenance and reliability. In the case of such an EP cartridge, a shutter is sometimes attached so as to prevent an external damage or light fatigue of the photoreceptor drum from occurring when the EP cartridge is taken out of the body of the image forming apparatus because it is necessary to keep portions of the photoreceptor drum uncovered adjacent the transfer and separation devices.

With respect to exposure, in the case of a laser beam printer, it is necessary to provide a slit-shaped light path having a width of several few mm between, a charger and a developing device. With respect to discharge, it is necessary to provide a light path having a width of at least about 10 mm so as to irradiate a photoreceptor drum with light from an LED. To attach the LED in the EP cartridge causes a problem in cost, and the device is generally configured so that a light path having the foregoing width is prepared in the EP cartridge, the LED being attached to the body of the apparatus. As disclosed in Japanese Patent Unexamined Publication No. Sho. 60-63549, a cover is attached to such a light path so as to prevent dust or the like from entering or to prevent light fatigue of the photoreceptor from occurring.

Thus, it is considerably difficult to achieve miniaturization while maintaining required printing quality. Particularly, it is difficult to provide a secure discharge light path. Further, since reliability is reduced as the number of movable members increases, as by the addition of a cover, it is desirable to reduce the number of movable members as much as possible.

SUMMARY OF THE INVENTION

It is therefore an object of the present invention to provide an image forming cartridge in which the degree of freedom in design of miniaturization of the image forming cartridge and an image forming apparatus can be increased and a member for shielding a discharge light path can be omitted.

In order to attain the above object, the present invention provides an image forming cartridge which is arranged to be removably attached to a body of an image forming apparatus, the apparatus comprising: latent image forming means for forming an electrostatic latent image corresponding to image information onto a photoreceptor; developing means for developing the latent image formed by the latent image forming means; transfer means for transferring the image developed by the developing means onto a transfer material; discharging means for radiating discharge light onto the photoreceptor to thereby discharge the photoreceptor after transfer operation by the transfer means; and feed means for feeding the transfer material to the transfer means and for discharging the transfer material after transfer operation by the transfer means, wherein the image forming cartridge includes at least the photoreceptor, the developing means, and discharge light path means for leading the discharge light to the photoreceptor as one body, the discharge light path means being bent so as to bend a light axis of the discharge light.

DETAILED DESCRIPTION OF THE PREFERRED EMBODIMENT

Figure 1:
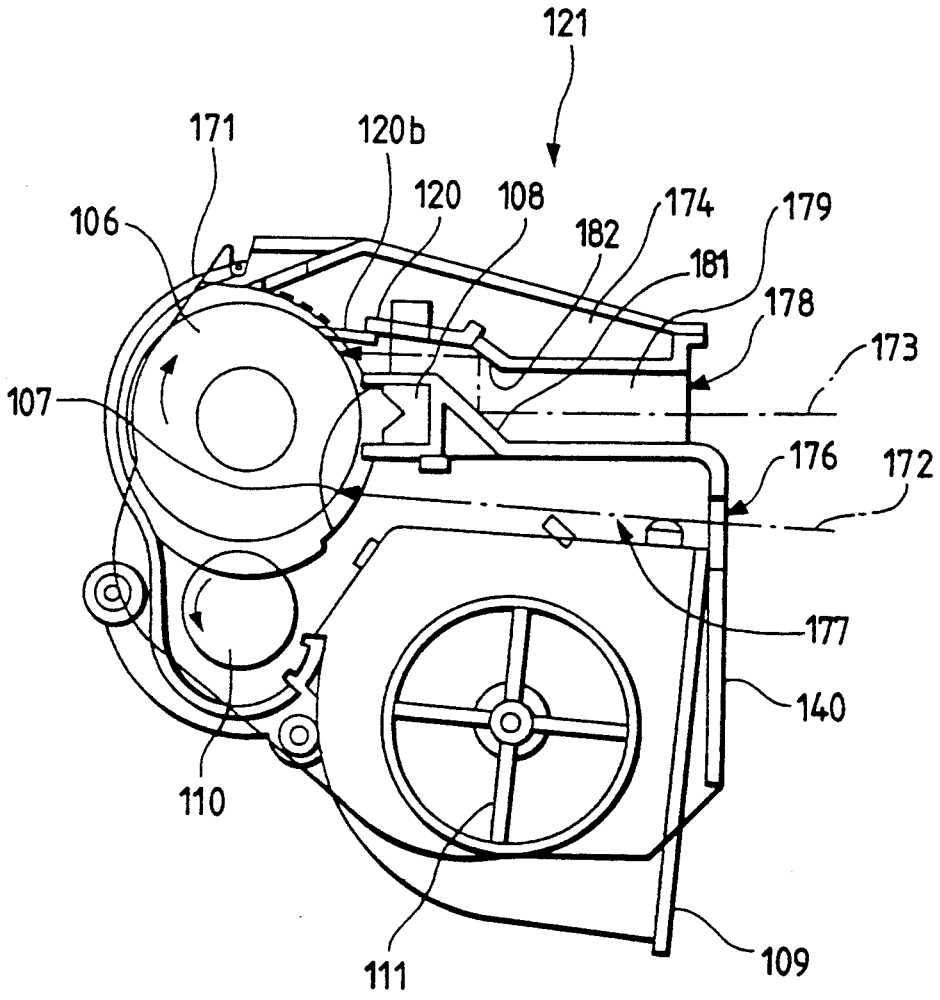
FIG. 1 is an explanatory diagram showing the schematic configuration of an embodiment of the EP cartridge according to the present invention.

Description will be made of an embodiment of the present invention with reference to the accompanying drawings. Related to an embodiment of the present invention, FIG. 1 is an explanatory diagram showing the schematic configuration of an EP cartridge, and FIG. 2 is an explanatory diagram showing the schematic configuration of a laser beam printer.

First, a laser beam printer will be described with reference to FIG. 2. In the drawing, the laser beam printer is viewed from the side surface, and the left-hand in the drawing corresponds to the front surface of the laser beam printer.

The laser beam printer 100 has a laser scanner 101. In the laser scanner 101 is a semiconductor laser (not shown) which modulates laser light in accordance with an image signal and outputs the modulated laser light. A laser beam emitted from the semiconductor laser is incident into a polygon mirror 102 and deflected in accordance with the rotation of the polygon mirror 102. After passing through an f8 lens 103, the deflected laser beam reflects off mirrors 104 and 105, thereby changing the beam direction outputted from the laser scanner 101.

Figure 2:
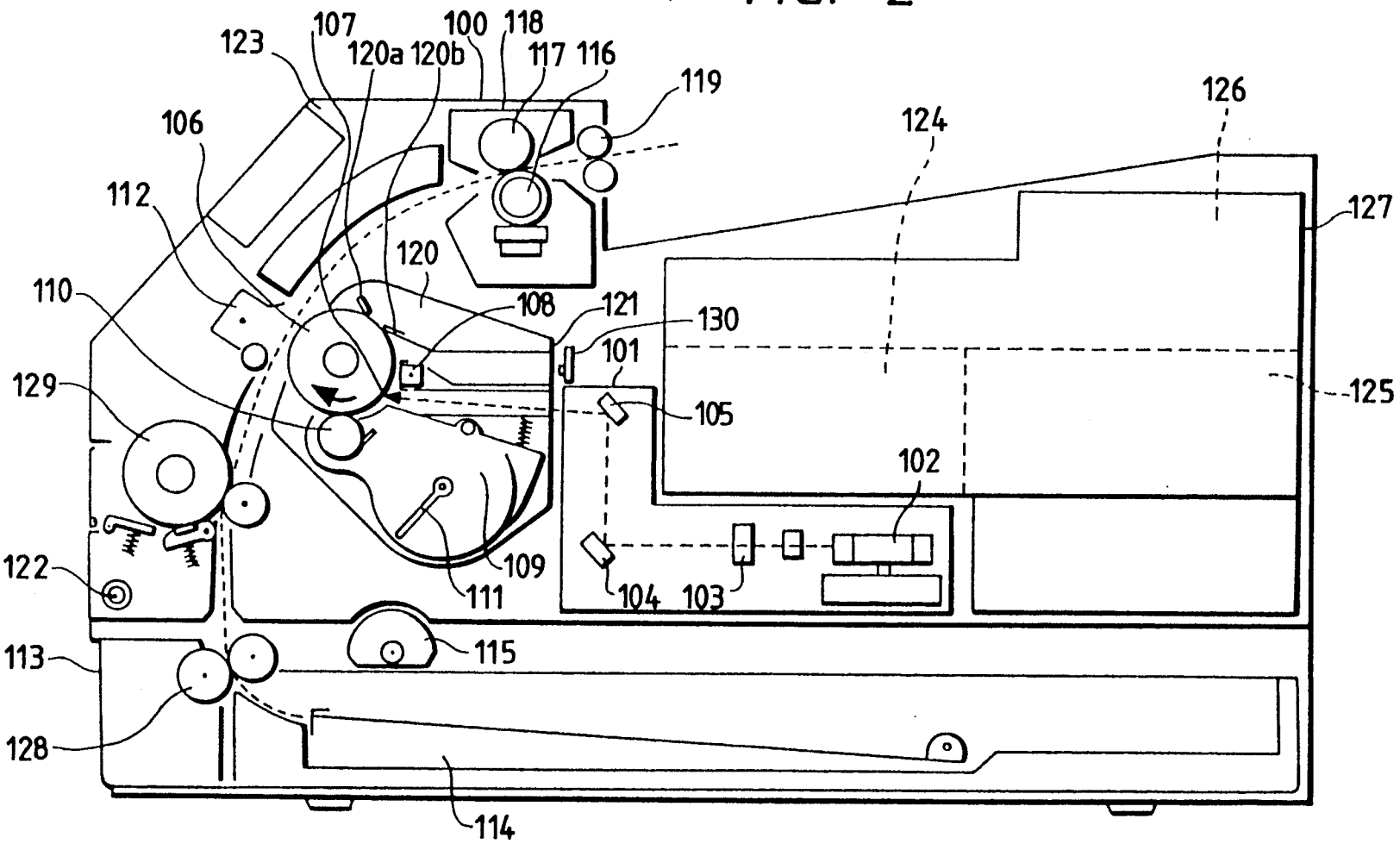
FIG. 2 is an explanatory diagram showing the schematic configuration of a laser beam printer including the EP cartridge of FIG. 1.
Figure 3:
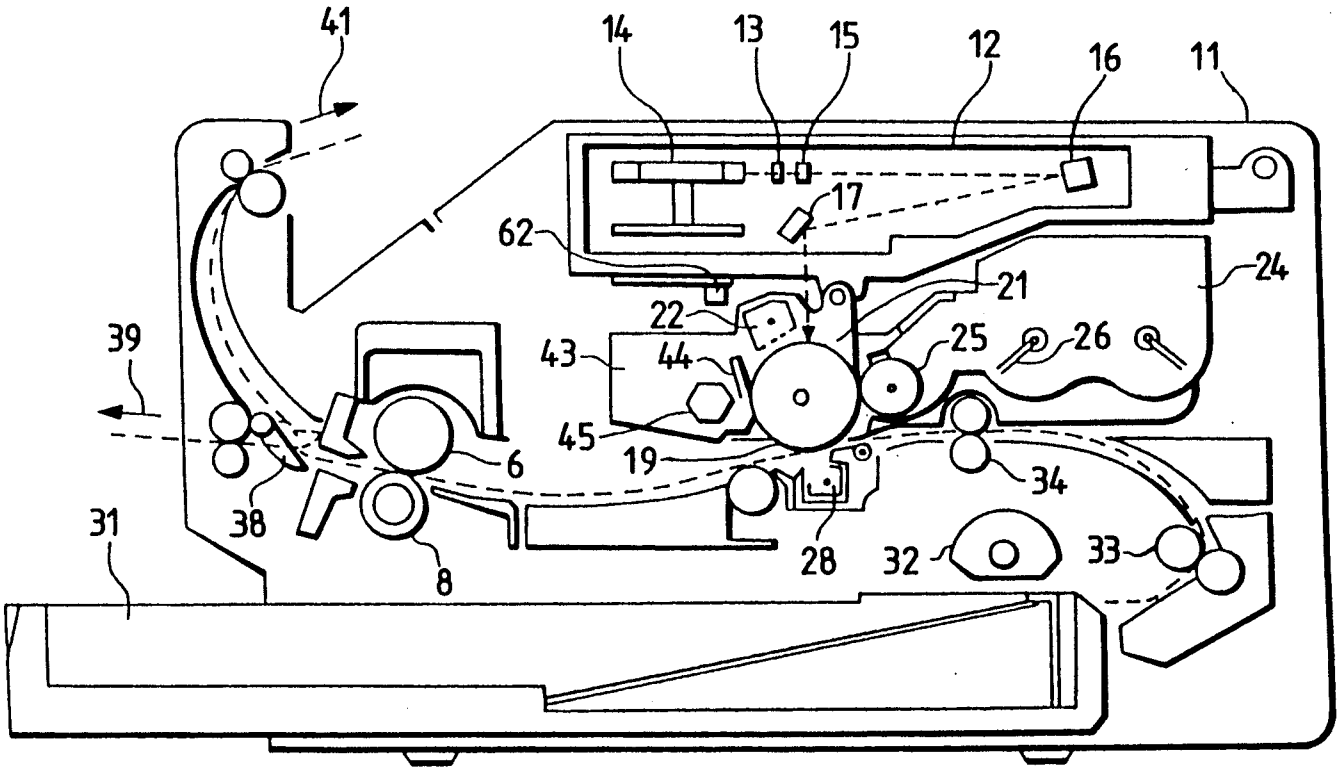
FIG. 3 PRIOR ART
FIG. 3 is an explanatory diagram showing the schematic configuration of a conventional laser beam printer.

A photoreceptor drum 106 which rotates at a fixed speed in the direction of an arrow shown in FIG. 2 is irradiated by the laser beam outputted from the laser scanner 101. The laser beam outputted from the laser scanner 101 repeatedly scans a predetermined exposure position 107 of the photoreceptor drum 106 in the direction of the axis of the photoreceptor drum 106, that is, in the main scanning direction.

A charge corotron 108 is provided in a position opposing the photoreceptor drum 106 slightly circumferentially spaced from the exposure position 107 so that a given position on the surface of the photoreceptor drum 106 is uniformly charged. The charged photoreceptor drum 106 is irradiated by the laser beam so that an electrostatic latent image corresponding to image information is formed on the drum surface. The electrostatic latent image is developed by a developing device 109 at a portion of the drum surface downstream along the direction of rotation of the drum 106 from the exposure position 107. Members such as a developing roll 110 for developing an electrostatic latent image by means of magnetically spiked toner, a toner supply mechanism 111 for supplying the developing roll 110 with toner out of a cartridge, and the like, are provided in the developing device 109. A predetermined development bias voltage is applied to the developing roll 110.

The toner image formed on the photoreceptor drum 106 by the developing device 109 is moved to a position opposite to a transfer corotron 112 as the photoreceptor drum 106 rotates, and is electrostatically transferred onto recording paper (ordinary paper). Each of the charge and transfer corotrons 108 and 112 used in this example has such a configuration that a single corotron wire is stretched in an air space covered with a shielding member and a voltage application terminal is provided at one end of the wire.

Next, a recording paper feeding path will be briefly described. Sheets of recording paper (not shown) are stacked in a cassette tray 114 removably disposed in a lower portion of the laser beam printer 100. The uppermost sheet of recording paper in the cassette tray 114 is fed out of the tray 114 by means of a semicircular roll 115. In place of the semicircular roll 115, sometimes, another means such as a retard roll or the like may be used.

The fed out recording paper is advanced by feeding rolls 128 along a path shown by a broken line so as to be stably fed at a fixed speed in synchronism with the rotational position of the photoreceptor drum 106. Thus, the recording paper passes in a timed manner between the photoreceptor drum 106 and the transfer corotron 112. The transfer corotron 112 performs discharging only at the time of this passage of the recording paper so that the toner image on the photoreceptor drum 106 is electrostatically attracted toward the transfer corotron 112 and transferred onto the recording paper. The back surface of the recording paper, after toner image transfer, is discharged by means of erasure needles (not shown) arranged downstream of the transfer corotron 112 so that the recording paper is separated from the drum surface during discharge. After being fed along a feeding path of a predetermined length so as to release its tension, the recording paper, now separated from the drum surface is sent to a fusing device 118 made of a pair of rolls, that is, a heat roll 116 and a pressure roll 117. In the fusing device 118, the recording paper passes between the heat and pressure rolls 116 and 117 which are nip rolls separated by a predetermined width. At this time, the recording paper surface carrying the toner image transferred thereto faces the heat roll 116 while the recording paper is pressed by the pressure roll 117 against the heat roll 116 allowing for efficient heat conduction. The heat roll 116 is controlled to be at a fixed high temperature. In this state, the toner image on the recording paper is thermally fixed on the paper surface.

Outlet rolls 119 are provided in the outlet of the fusing device 118, and the recording paper fed between the outlet rolls 119 is discharged to an upper portion of the laser beam printer 100. The recording paper is discharged with the recording surface turned downward so that sheets of recording paper successively printed page by page can be bound by using a stapler as they are in proper numerical order.

The toner image which has not been transferred onto recording paper is removed from the drum surface by a cleaning device 120 arranged downstream along the direction of rotation of the drum 106 from the transfer corotron 112. The cleaning device 120 is provided with a blade **120*b* for scraping toner from the drum surface and a film 120*a* for preventing toner from escaping. Further, the cleaned photoreceptor drum 106 is discharged by discharge light emitted from an erasure light lamp 130** constituted, for example, by an LED or the like.

In the laser beam printer 100 according to this embodiment, the photoreceptor drum 106, the cleaning device 120, the charge corotron 108, and the developing device 109 are integrally provided with each other in an EP cartridge 121 which is arranged so as to be removably attached to the body of the laser beam printer. Further, the laser beam printer 100 according to this embodiment has a front cover 123 which opens/closes about a hinge 122. Opening the front cover 123, a user can very easily perform removal of paper jamming and exchange of the EP cartridge 121 and the transfer corotron 112. Moreover, the laser beam printer 100 according to this embodiment is arranged so that the user attaches/removes the fusing device 118 easily.

A power source portion 124 constituted by low and high power sources is arranged behind the laser scanner 101 so as to supply the constituent parts with required electric power. A controller 125 is arranged behind the power source portion 124 so as to electrically control the laser beam printer 100. An image information processor 126 is disposed above the power source portion 124 and the controller 125 so as to send image information from a computer or the like to the controller 125 after the image information has been translated into the language of the laser beam printer 100.

As described above, in the laser beam printer 100 according to this embodiment, so-called mechanical constituent parts are provided in the front portion of the printer 100, while so-called electrical constituent parts 127 are provided in the rear portion of the printer 100.

Next, referring to FIG. 1, the EP cartridge 121 will be described. In the EP cartridge 121, the photoreceptor drum 106, the cleaning device 120, the charge corotron 108, the developing device 109, and a drum shutter 171 are integrally provided in a housing 140. When the EP cartridge 121 is inserted into the body of the laser beam printer and the apparatus cover is closed, the drum shutter 171 for covering the photoreceptor drum 106 is opened.

In the EP cartridge 121, a laser light path 177 extending from a slit 176 formed in the housing 140 to the photoreceptor drum 106 is provided between the charge corotron 108 and the developing device 109. Further, an opening 178 for discharge light is formed behind the charge corotron 108 in the vicinity of the slit 176, and a discharge light path 179 extending from the opening 178 to the photoreceptor drum 106 is provided in the EP cartridge 121. Although the discharge light path 179 is substantially parallel to the laser light path 177 from the opening 178 to a position in the vicinity of the back surface of the charge corotron 108, the path 179 is bent sideward in the vicinity of the back surface of the charge corotron 108 and extends to the photoreceptor drum 106 through a space between the charge corotron 108 and the cleaning device 120. In the discharge light path 179, a first reflection surface 181 for bending a light path of discharge light 173 entered from the opening 178 toward the side surface of the charge corotron 108 is provided at a position in the vicinity of the back surface of the charge corotron 108, and a second reflection surface 182 for further bending the light path toward the photoreceptor drum 106 is provided in the bent light path. The erasure lamp 130 is provided in the body of the laser beam printer in opposition to the opening 178 as shown in FIG. 2.

First, the photoreceptor drum 106 rotates in the direction of an arrow shown in the drawing so as to be charged by the charge corotron 108 to a predetermined electric potential. Next, the photoreceptor drum 106 is exposed by a laser beam 172 which is emitted from the laser scanner 101 to irradiate the photoreceptor drum 106 through the slit 176 and the laser light path 177, so that a latent image is formed on the photoreceptor drum 106. The latent image is developed by the developing roll 110 of the developing device 109. Toner is supplied from a toner box (not shown) to the developing roll 110 by a toner feed means (not shown), and then the developing roll 110 rotates so that a thin and uniform toner layer is formed on the developing roll 110 by a thin layer forming means (not shown).

A developed image on the photoreceptor drum 106 is transferred onto a transfer material (recording paper) by a transfer device (not shown), and non-transferred toner on the photoreceptor drum 106 is removed by the cleaning device 120. The removed toner is successively moved rearward and received in a toner collection box 174.

The cleaned photoreceptor drum 106 is discharged by the discharge light 173 which is emitted from the erasure lamp 130 so as to radiate the photoreceptor drum 106 through the bent discharge light path 179.

As described above, in this embodiment, the light path for the discharge light 173 is bent twice. This is because the capacity of the toner collection box 174 is made sure and a dead space formed behind the charge corotron 108 is effectively utilized. The light path for the discharge light 173 is bent so that the space can be effectively utilized while securing the necessary function of each of the constituent parts of the EP cartridge 121. As a result, the EP cartridge can be miniaturized.

The quantity of discharge light 173 is inevitably reduced by reflection of the discharge light 173. When the housing 140 is made of resin, however, the resin surface of each of the first and second reflection surface portions 181 and 182 is made smooth to thereby obtain a sufficient discharge effect. Further, even when the number of times of reflection of the discharge light 173 is increased for various reasons, a sufficient discharge effect is obtained if each of the reflection surfaces is formed into a mirror surface.

Further, in this embodiment, external light can be prevented from entering from the discharge light path 179 by bending the light path for the discharge light 173. That is, when the EP cartridge 121 is taken out of the body of the laser beam printer, external light hardly enters directly into the discharge light path 179 along the light path for the discharge light. Indirectly entering external light is reflected by an inner wall of the bent discharge light path 179 a plurality of times, and as a result, the quantity of light extremely decreases so that the external light hardly contributes to light fatigue of the photoreceptor drum 106. Therefore, a shielding member such as a shutter, a cover, or the like, for shielding the discharge light path can be omitted. As a result, the cost of each of the EP cartridge 121 and the laser beam printer 100 can be reduced, and the reliability is improved by reduction of the number of the movable members by one.

It is a matter of course that the present invention can be applied also to a copying machine.

As described above, according to the present invention, the light path for the discharge light in the image forming cartridge is bent so that the constituent parts of the image forming cartridge can be arranged efficiently. Therefore, the degree of freedom of design in miniaturization of the image forming cartridge and the image forming apparatus increases. Further, since the quantity of external light other than discharge light to reach the photoreceptor can be reduced, the shielding member for the discharge light path can be emitted.

What is claimed is:

1. An image forming cartridge for use in an image forming apparatus having a body in which an electrostatic latent image corresponding to image information is formed, the latent image is developed, the developed image is transferred onto a transfer material, and discharge light is radiated after transfer, said image forming cartridge comprising:

a housing removably attachable to the body of the image forming apparatus;

a photoreceptor disposed within said removably attachable housing and on which the latent image is formed;

developing means disposed within said removably attachable housing for developing the latent image formed on said photoreceptor; and discharge light path means disposed within said removably attachable housing for transmitting the discharge light from discharging means in the body of said image forming apparatus to said photoreceptor, said discharge light path means including first and second reflection surfaces for directing the discharge light along a bent light path.

2. An image forming apparatus having latent image forming means for forming on a photoreceptor an electrostatic latent image corresponding to image information, developing mans for developing the latent image formed by said latent image forming means, transfer means for transferring the image developed by said developing means onto a transfer material, discharging means for radiating discharge light onto the photoreceptor to thereby discharge the photoreceptor after transfer operation by said transfer means, and feed means for feeding the transfer material to said transfer means and for discharging the transfer material after transfer operation by said transfer means, said apparatus comprising:

a body in which said latent image forming means, said transfer means, said discharge means and said feed means are mounted; and an image forming cartridge removably attachable to said body and including at least said photoreceptor, said developing means, and discharge light path means for transmitting said discharge light from said discharging means to said photoreceptor, said discharge light path means including first and second reflection surfaces for directing said discharge light along a bent discharge light path.

3. An image forming apparatus as in claim 2, further including charging means for charging said photoreceptor and cleaning means for cleaning said photoreceptor after transfer operation by said transfer means, said cleaning means being disposed in said cartridge and said charging means being disposed in said cartridge between said photoreceptor and said first reflection surface, said first reflection surface directing said discharge light past a side surface of said charging means to said photoreceptor through a space between said charging means and said cleaning means.

4. An image forming apparatus comprising:

a body;

latent image forming means attached to said body for forming an electrostatic latent image corresponding to image information;

developing means for developing the latent image formed by said latent image forming means;

transfer means attached to said body for transferring the latent image developed by said developing means onto a transfer material;

discharging means attached to said body for radiating discharge light after transfer operation by said transfer means;

feed means attached to said body for feeding the transfer material to said transfer means and for discharging the transfer material after transfer operation by said transfer means; and an image forming cartridge having a housing removably attachable to said body, said removably attachable housing including a photoreceptor on which the latent image is formed, said developing means, and discharge light path means for transmitting the discharge light from said discharging means to said photoreceptor, said discharge light path means including first and second reflection surfaces for directing the discharge light along a bent discharge light path.

5. An image forming apparatus as in claim 4, further including charging means disposed within said removably attachable housing of the image forming cartridge for charging a surface of said photoreceptor and cleaning means disposed within said removably attachable housing of the image forming cartridge for cleaning said photoreceptor after transfer operation of said transfer means, said first reflection surface being disposed adjacent to a rear portion of said charging means furthest from said photoreceptor for directing said discharge light past a side surface of said charging means to said photoreceptor through a space between said charging means and said cleaning means.

* * * * *

UNITED STATES PATENT AND TRADEMARK OFFICE

CERTIFICATE OF CORRECTION

PATENT NO. : 5,267,001

DATED : November 30, 1993

INVENTOR(S) : Makoto Kanai et al.

It is certified that error appears in the above-indentified patent and that said Letters Patent is hereby corrected as shown below:

Claim 2, column 9, line 1, change "mans" to --means--.

Signed and Sealed this

Twenty-third Day of August, 1994

*Attest:*

Bruce Lehman

BRUCE LEHMAN

*Attesting Officer*

*Commissioner of Patents and Trademarks*